United States Patent [19]

Wu et al.

[11] 4,362,100

[45] Dec. 7, 1982

[54] ENVELOPE FEEDER

[75] Inventors: Edward S. Wu, Fremont, Calif.; Roger R. Soulard, Dracut, Mass.

[73] Assignee: Wang Laboratories, Inc., Lowell, Mass.

[21] Appl. No.: 167,465

[22] Filed: Jul. 11, 1980

[51] Int. Cl.[3] ..... B41F 13/24

[52] U.S. Cl. ..... 101/233; 400/629; 400/631; 271/2; 271/258; 271/259

[58] Field of Search ..... 101/232-242; 493/320, 321, 323; 400/629, 631, 636.2, 636.3, 637.1, 624, 625; 271/2, 258, 259, 265, 165

[56] References Cited

U.S. PATENT DOCUMENTS

| | | | |
|---|---|---|---|
| 1,349,940 | 8/1920 | Bowes | 101/240 |
| 2,756,673 | 7/1956 | George | 101/233 |
| 3,048,099 | 8/1962 | Davidson, Jr. et al. | 101/233 |
| 3,217,639 | 11/1965 | Kelly | 101/233 |
| 3,763,775 | 10/1973 | Miles | 101/233 |
| 3,771,443 | 11/1973 | Georghallis | 101/233 |
| 4,015,523 | 4/1977 | Evans et al. | 101/233 |
| 4,030,409 | 6/1977 | Adhikari et al. | 101/233 X |
| 4,080,060 | 3/1978 | Nothmann | 101/232 X |

OTHER PUBLICATIONS

"Weighted Pinch Rolls" Clark, Xe. Disclosure Journal, vol. 2, No. 6, Nov./Dec. 1977, pp. 57-59.

"Air Adjustment-Automatic" Wenthe, Xe Disclosure Journal, vol. 5, No. 4, Jul./Aug. 1980, p. 383.

"Paper Feed" Duneau, IBM Technical Disclosure Bulletin, vol. 8, No. 1, Jun. 1965, p. 175.

"Document Gate & Feed Control Mechanism" Maliwackl, IBM Tech. Discl. Bulletin, vol. 11, No. 2, Jul. 1968.

*Primary Examiner*—E. H. Eickholt

[57] ABSTRACT

An envelope feeder which can be mounted on a printer having a rotatable platen and a printing head for automatically feeding, printing and stacking envelopes is disclosed. It has a blank envelope feeding hopper from which blank envelopes are extracted one at a time and fed by a transporting roll and belt mechanism to the printer platen for printing. The position of the envelope is sensed when it reaches the printer platen and the transporting mechanism stopped for printing of the envelope by the printing head. After printing is completed, the transporting mechanism is reactivated to deliver the printed envelope to an envelope receiving hopper for stacking in sequence with other printed envelopes.

11 Claims, 7 Drawing Figures

FIG 3
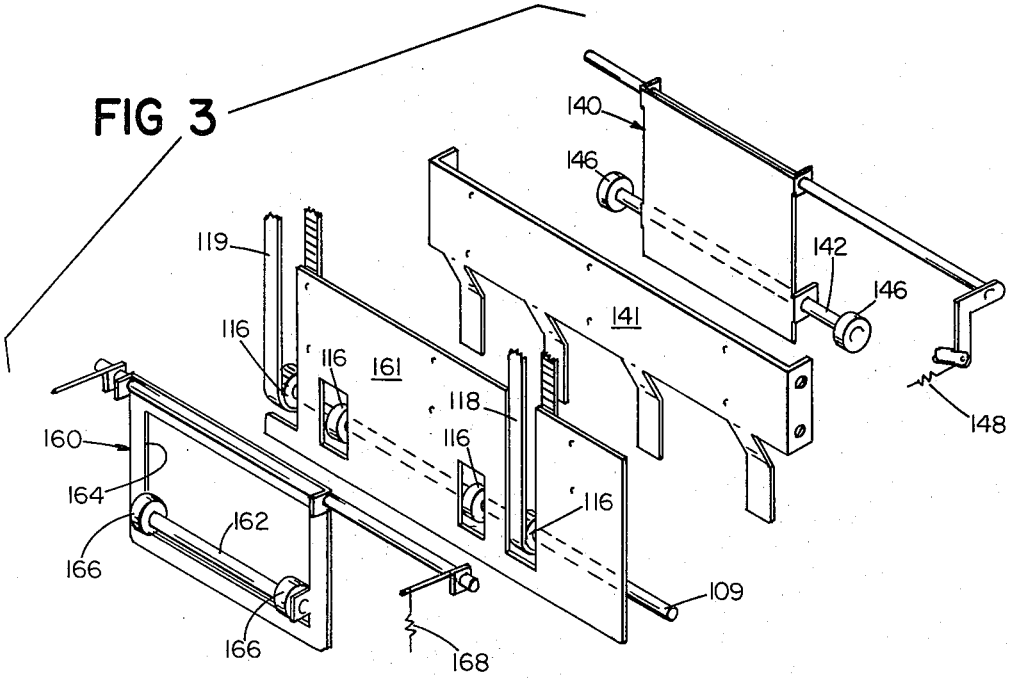
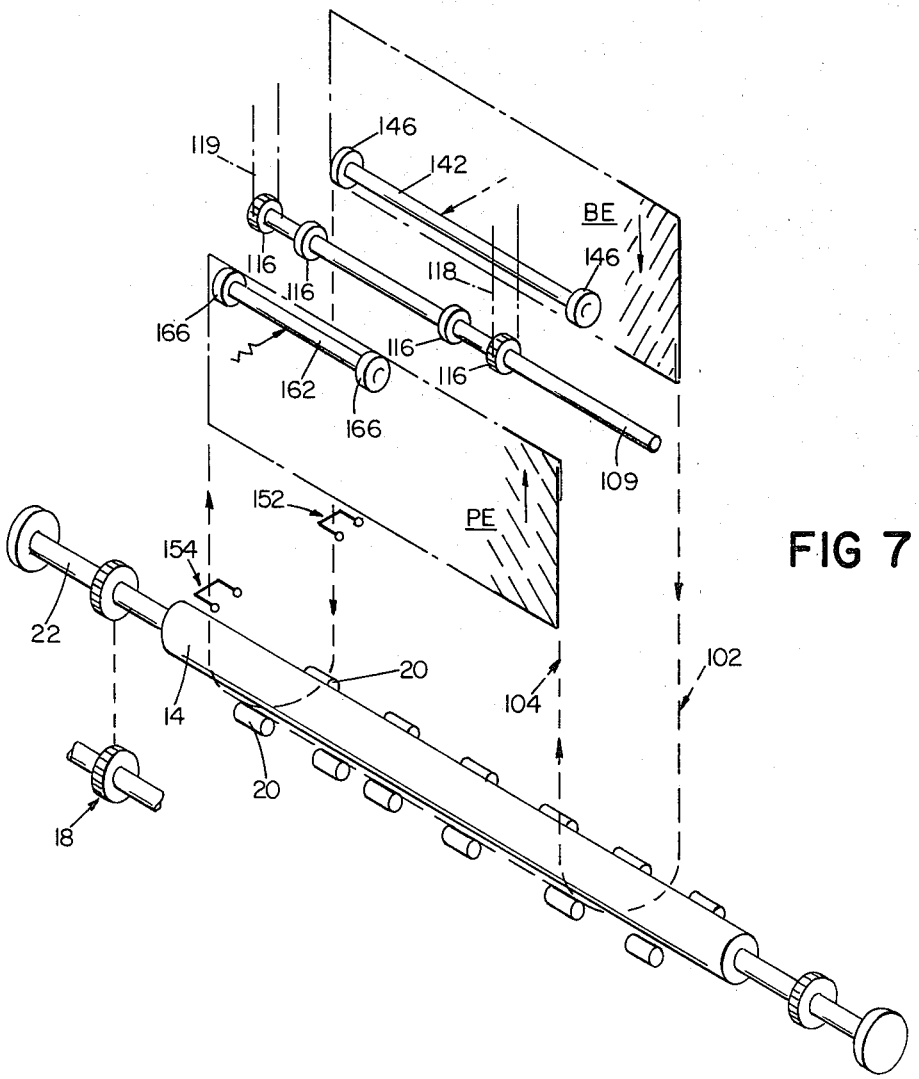
FIG 7

6
5
10
12
14
18
20
22
30
32
34
35
38
39
62
63
68
70
80
82
84
86
90
92
106
107
108
109
110
111
112
113
116
118
119
122
123
130
132
133
136
140
141
146
148
150
154
160
161
162
164
166
168

ENVELOPE FEEDER

This invention relates to printers and more particularly to envelope feeding mechanisms therefor.

There are a variety of sheet handling machines in the prior art for use with high speed printers or the like and the advent of word processing systems employing such high speed printers has resulted in quick and efficient production of letters and documents. However, such systems of the prior art are deficient in that they lack comparable high speed and efficient envelope printing capabilities, so that, for example, the operator still must manually handle and type an envelope for a letter or document produced by the system.

Accordingly, it is a major object of the present invention to provide novel envelope feeding mechanisms for use with a printer.

It is another major object of the present invention to provide novel envelope stacking mechanisms for sequentially stacking individual envelopes delivered from a printer.

The above and still further objects of the present invention are provided by a novel envelope feeder for a printer having a rotatable platen and cooperating printing means, platen drive means, and platen pinch roll means. The novel envelope feeder, in general, comprises a blank envelope feeding hopper, a printed envelope receiving hopper, and envelope transporting means for individually transporting blank envelopes to the printer platen and, after printing, transporting them from the platen to the receiving hopper.

Printing position envelope sensing means is provided for sensing the presence of the extracted blank envelope positioned on the printer platen ready for printing, the transporting means being responsive to the printing position envelope sensing means to stop the transporting means for printing of the extracted envelope by the printer. The transporting means is also responsive to the completion of printing and is then reactivated to deliver the printed envelope from the printer platen to the printed envelope receiving hopper.

In one aspect of the invention, envelope extracting means is provided for individually extracting an envelope from the stack of blank envelopes in the blank envelope feeding hopper. It preferably includes envelope engaging roll means adapted to contact the last envelope at the side of the stack of blank envelopes opposite the blank envelope feeding hopper vertical rear wall for extracting the last envelope from the stack of blank envelopes.

In another aspect, the present invention provides a novel envelope feeder including envelope feed guide means spaced above the surface of the envelope engaging roll means for guiding a single envelope from the stack of blank envelopes.

In a third aspect, the present invention provides a novel envelope feeder for a printer comprising envelope transporting means preferably having envelope transporting roll and belt means defining input and output paths. The transporting means rotates about axes spaced from and parallel to the axis of the envelope engaging roll means and includes lower transporting means.

Preferably, rear envelope guide means is provided for guiding the extracted blank envelope being carried along the input path by the envelope transporting means to the printer platen. More specifically, the rear guide means has rear guide roll means rotatably mounted on the rear guide means for rotation about an axis spaced from and parallel to the axis of the lower transporting means, spring means normally urging the rear guide means lightly toward the lower transporting means to allow the envelope to position itself between the platen pinch roll means and the platen, solenoid means for urging the rear guide roll means of the rear guide means firmly into engagement with the lower transporting means to force the envelope into the nip between the platen pinch roll means and the platen, and rear guide envelope sensing means for sensing the presence of the envelope positioned between the platen pinch roll means and the platen, the rear guide envelope sensing means actuating the solenoid means to drive the envelope around the printer platen and position it for printing.

In a further aspect, the present invention provides a novel envelope feeder including front envelope guide means for guiding the printed envelope from the printer platen along the output path. More specifically, the front guide means has front guide roll means rotatably mounted on the front guide means for rotation about an axis spaced from and parallel to the axis of the lower transporting means, the front guide means guiding the printed envelope traveling on the transporting means along the output path to the printed envelope receiving hopper.

For the purpose of more fully explaining the above and still further objects and features of the present invention, reference is now made to the following detailed description of a preferred embodiment thereof, together with the accompanying drawings, wherein:

FIG. 3 is an isometric exploded view of the front envelope guide means and the rear envelope guide means of the envelope feeder of FIG. 2;

FIG. 7 is an isometric, exploded, diagrammatic view of a portion of the envelope feeder of FIG. 2.

Figure 1:
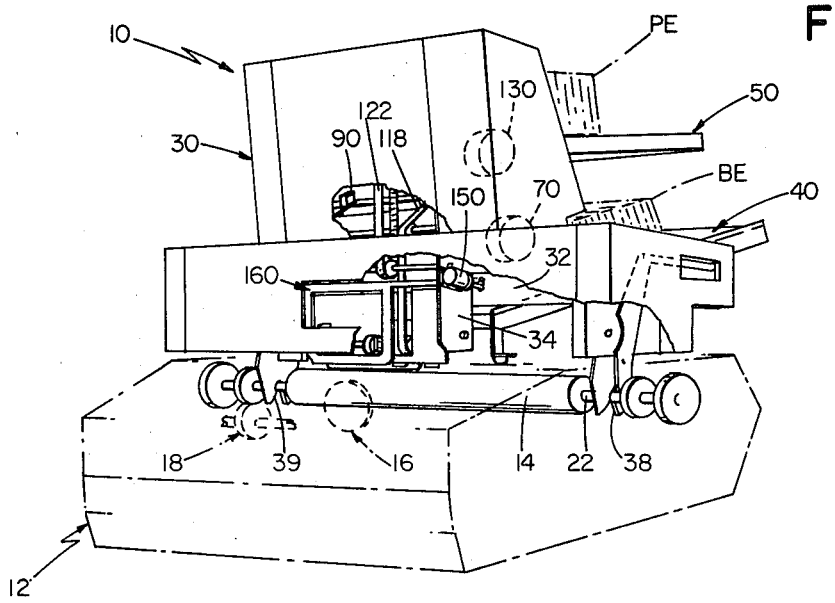
FIG. 1 is an isometric view of the envelope feeder according to the present invention shown mounted on a printer.

Referring to the drawings, the envelope feeder of the present invention, generally designated 10, is adapted to be removably mounted on a printer, generally designated 12, having rotatable platen 14, print head 16, platen drive mechanism 18, and platen pinch rolls 20, as best shown in FIGS. 1, 2, 4, 5, 6 and 7.

Figure 2:
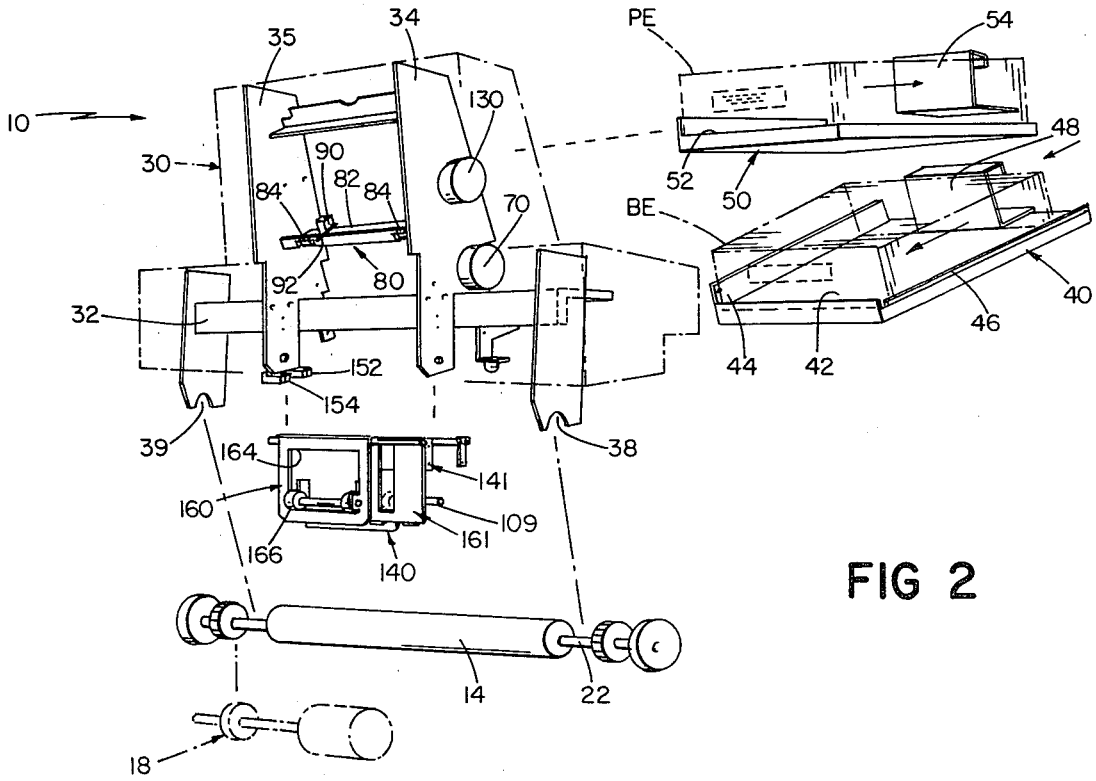
FIG. 2 is an isometric exploded view of the envelope feeder of FIG. 1.
Figure 4:
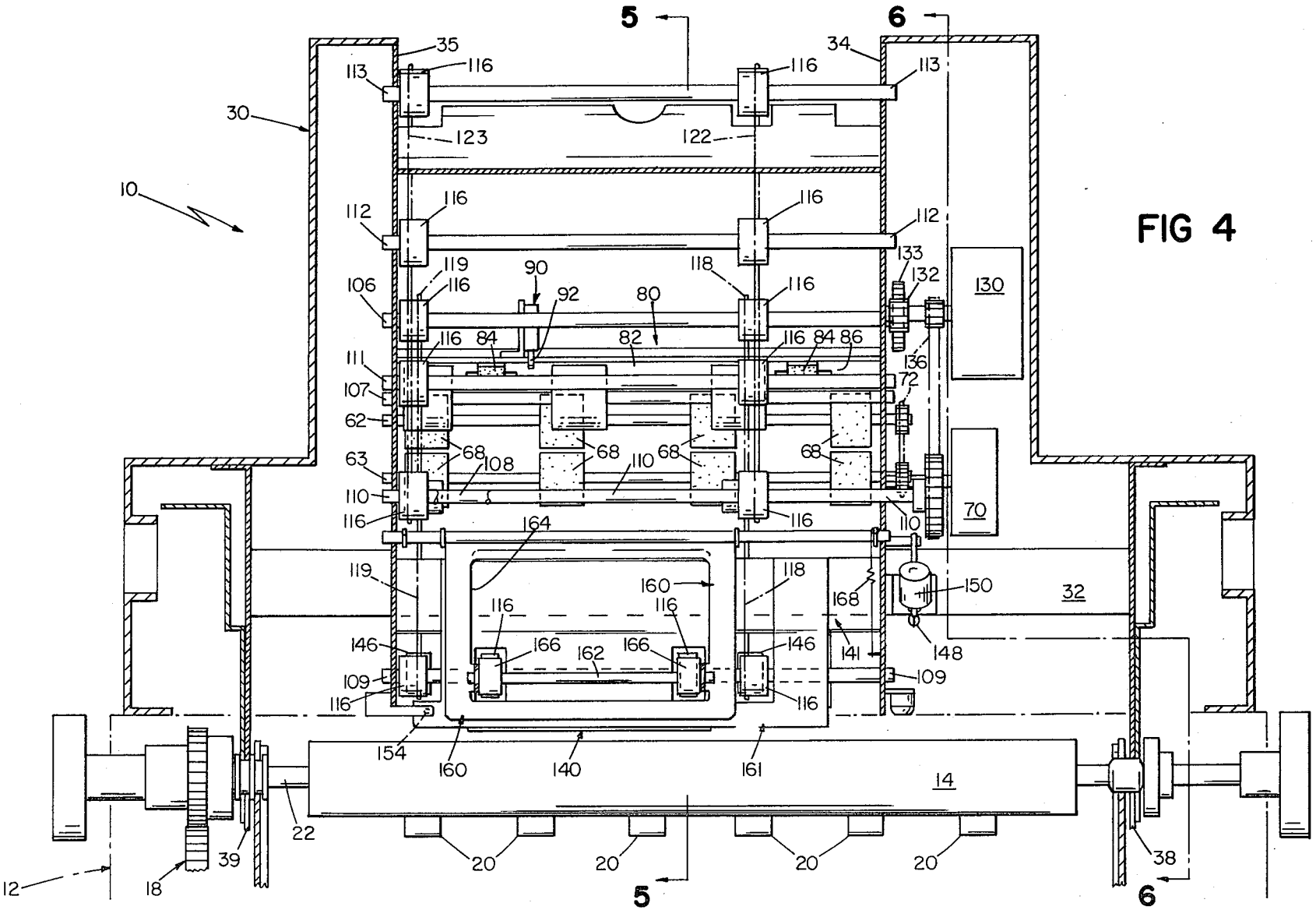
FIG. 4 is a vertical sectional front view of the envelope feeder of FIG. 2.

More specifically, envelope feeder 10 has a supporting frame 30 adapted to be mounted on printer 12 extending thereabove. Supporting frame 30 includes a transversely extending base support member 32 having end support plates 34 and 35. Base support member 32, as best shown in FIGS. 1, 2 and 4, has downwardly facing semicircular notches 38 and 39 for receiving platen shaft 22 of printer 12 for removably retaining envelope feeder 10 in operating position thereon.

A blank envelope feeding hopper 40 is provided on feeder 10 for supporting a stack of blank envelopes BE to be printed. Hopper 40 includes a generally horizontal, downwardly sloped, bottom wall 42 mounted on frame 30, generally vertical adjustable side walls 44 and 46, and a generally vertical movable rear wall 48.

Also provided on feeder 10 is a printed envelope receiving hopper 50 having a generally horizontal, upwardly sloped, bottom wall 52 mounted on frame 30 and a generally vertical movable rear wall 54 for supporting a stack of printed envelopes PE.

Figure 6:
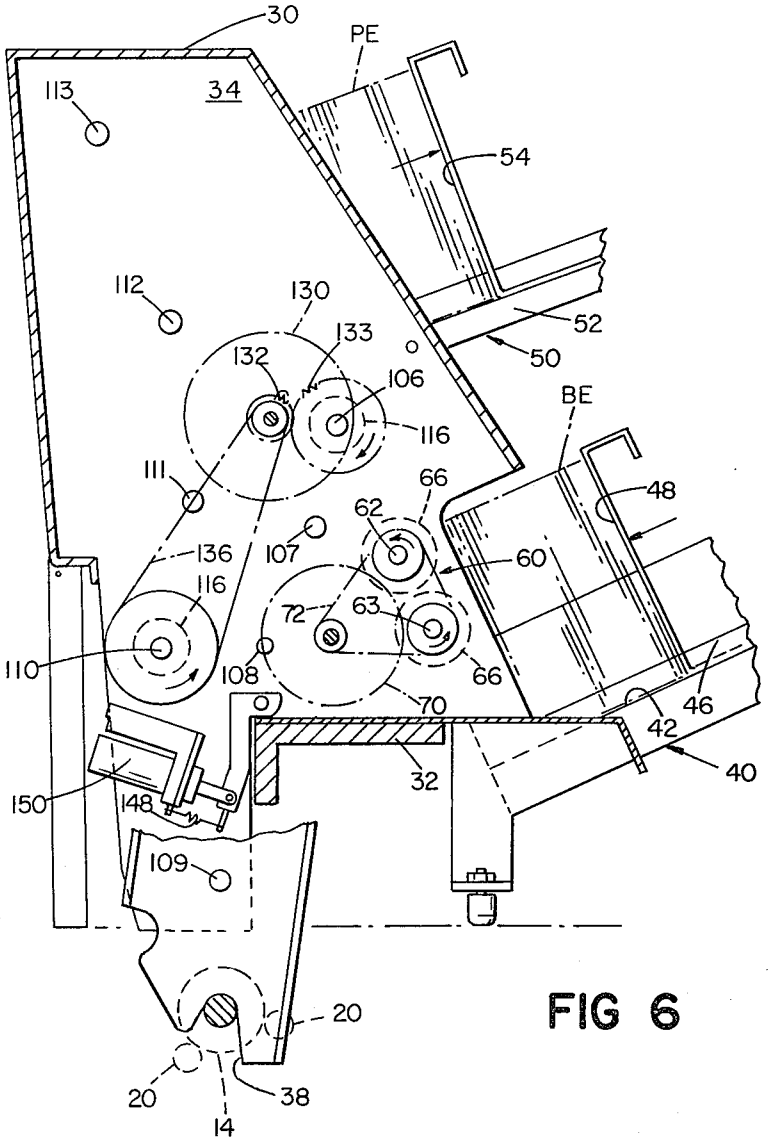
FIG. 6 is a vertical sectional end view, partly broken away, of the envelope feeder of FIG. 2, taken on line 6—6 of FIG. 4.
Figure 5:
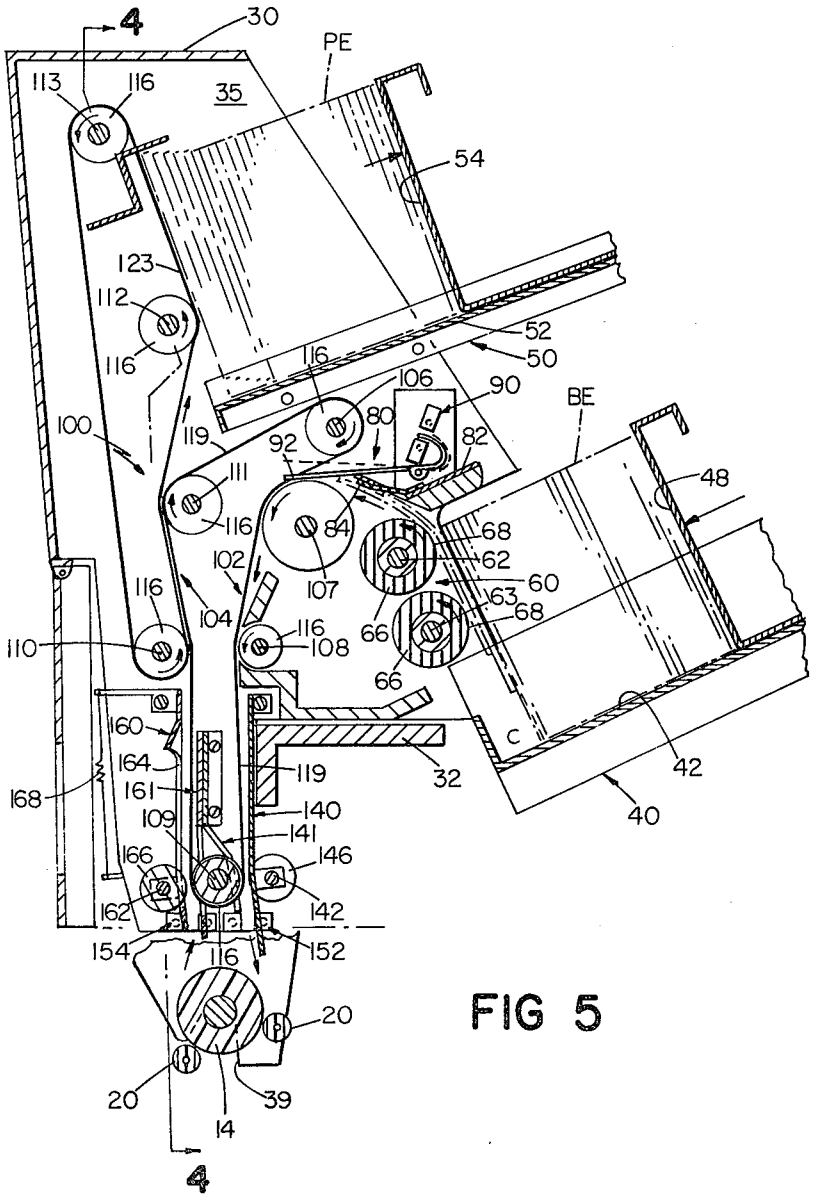
FIG. 5 is a vertical sectional end view of the envelope feeder of FIG. 2, taken on line 5—5 of FIG. 4.

Envelope extracting mechanism, generally designated 60 and best shown in FIGS. 5 and 6, is mounted on frame 30 for individually extracting a single envelope from the stack of blank envelopes BE in blank envelope feeding hopper 40. Extracting mechanism 60 includes a pair of vertically spaced horizontal drive shafts 62 and 63 rotatably mounted on and extending between end support plates 34 and 35 for rotation about axes spaced from and parallel with blank envelope feeding hopper vertical rear wall 48. A plurality of envelope engaging rolls 66 are mounted on each of shafts 62 and 63. Envelope engaging rolls 66 have high friction peripheral surfaces 68 for extracting the last envelope at the side of the stack of blank envelopes BE opposite blank envelope feeding hopper vertical rear wall 48, the stack of blank envelopes being normally urged toward envelope engaging rolls 66 by movable blank envelope feeding hopper vertical rear wall 48. The combined action of blank envelope feeding hopper vertical rear wall 48 and envelope engaging rolls 66 supports the stack of blank envelopes BE stacked therebetween, thereby facilitating the extraction of the last envelope from the stack of blank envelopes BE. Drive shafts 62 and 63 are driven through envelope extracting belt 72 by envelope extracting motor 70 mounted on end support plate 34.

Envelope feed guide mechanism, generally designated 80, best shown in FIGS. 2, 4 and 5, spaced above the peripheral surfaces 68 of envelope engaging rolls 66, is provided for individually separating and guiding a single envelope from the stack of blank envelopes BE. Feed guide mechanism 80 includes horizontal bracket 82 mounted between end support plates 34 and 35, the undersurface 86 of bracket 82 having friction surfaces 84 thereon for individually separating and guiding one envelope at a time along input path 102 toward printer 12.

Extracted envelope sensing switch 90, best shown in FIGS. 2, 4 and 5, is mounted on feed guide bracket 82 and includes switch arm 92 for sensing the presence of the last blank envelope BE. Switch 90 functions to stop envelope extracting motor 70 after a single envelope has been extracted to prevent feeding more than a single envelope at a time along input path 102 toward printer 12.

Envelope transporting mechanism, generally designated 100, best shown in FIGS. 5 and 7, is provided for transporting an individual extracted blank envelope BE from feed guide mechanism 80 along input path 102 to printer platen 14 and, after the envelope has been printed, transporting the extracted printed envelope PE along output path 104 from printer platen 14 to printed envelope receiving hopper 50. Transporting mechanism 100 includes a pair of vertically spaced drive shafts 106 and 110 and a plurality of roll shafts 107, 108, 109, 111, 112 and 113, all rotatably mounted on and extending between end support plates 34 and 35 for rotation about axes spaced from and parallel with envelope extracting drive shafts 62 and 63. Each of the transporting drive and roll shafts has a plurality of envelope transporting rolls 116 mounted thereon.

Transporting mechanism 10 further includes a pair of transversely spaced, elastic endless belts 118 and 119, the portions of which extending between rolls 116 on shafts 107 and 109 define input path 102, along which blank envelopes are carried from envelope feed guide mechanism 80. Belts 118 and 119 are trained around envelope transporting rolls 116 of drive shaft 106 and roll shafts 109 and 111. Arcuate portions of input path belts 118 and 119 normally engage transporting rolls 116 of roll shafts 107 and 108 and drive shaft 110 to carry individual blank envelopes between them and belts 118 and 119 along input path 102.

Transporting mechanism 100 also includes another pair of transversely spaced, elastic endless belts 122 and 123, the portions of which extending between rolls 116 on shafts 110 and 112 define output path 104, along which printed envelopes are carried to printed envelope receiving hopper 50. Belts 122 and 123 are trained around transporting rolls 116 of drive shaft 110 and roll shafts 112 and 113. Portions of output path belts 122 and 123 also normally contact portions of belts 118 and 119 between drive shaft 110 and roll shaft 111 to carry printed envelopes therebetween along output path 104. Transporting drive shafts 106 and 110 are driven by envelope transporting motor 130 mounted on end support plate 34, drive shaft 106 being driven through gears 132 and 133 and drive shaft 110 being driven through envelope transporting belt 136.

Rear envelope guide mechanism, best shown in FIGS. 2, 3 and 5, is provided for guiding the extracted blank envelope BE, traveling on input path belts 118 and 119, to printer platen 14. The rear guide mechanism includes rear guide bracket 140, pivotally mounted on and extending between end support plates 34 and 35, and a fixed rear guide plate 141, parallel to the rear guide bracket 140, mounted on and extending between end support plates 34 and 35. Rear guide bracket 140 has a rear guide roll shaft 142 mounted thereon, which includes a plurality of rear guide rolls 146 rotatably mounted thereon for rotation about an axis spaced from and parallel with the axis of lower transporting roll shaft 109. Rear guide rolls 146 are positioned adjacent to and normally spaced from transporting rolls 116 of lower transporting roll shaft 109. Spring 148 mounted on frame 30 normally maintains rear guide bracket 140 lightly urged toward lower transporting roll shaft 109 to allow the blank envelope BE to position itself between platen pinch rolls 20 and printer platen 14. Solenoid 150 mounted on end support plate 34 is provided for swinging bracket 140 toward lower transporting roll shaft 109, thereby urging rear guide rolls 146 of bracket 140 into firm nipping engagement with belts 118 and 119 trained around transporting rolls 116 of lower transporting roll shaft 109 in order to force the blank envelope BE compressed therebetween into the nip between platen pinch rolls 20 and printer platen 14.

A rear guide envelope sensing photocell 152 mounted on end support plate 35, as best shown in FIGS. 2, 4 and 5, is provided for sensing the presence of the blank envelope BE positioned between platen pinch rolls 20 and printer platen 14. Its sensing signal then actuates solenoid 150 to drive the blank envelope BE around printer platen 14. For sensing the presence of the blank envelope BE positioned on printer platen 14 for printing, a printing position envelope sensing photocell 154 is mounted on end support plate 35, photocell 154 being connected and arranged to disable the envelope transporting motor 130 in order to stop envelope transporting mechanism 100 and to allow for printing of the extracted blank envelope BE by printer 12 in the usual manner.

Upon the completion of printing of the envelope, envelope transporting motor 130 then activates envelope transporting mechanism 100 to deliver the printed envelope PE along output path 104 from printer platen 14 to printed envelope receiving hopper 50.

Front envelope guide mechanism, best shown in FIGS. 2, 3 and 5, is provided for guiding the printed envelope PE from printer platen 14 along output path 104. The front envelope guide mechanism includes a front guide bracket 160 pivotally mounted on and extending between end support plates 34 and 35 and a fixed front guide plate 161 parallel to front guide bracket 160 also mounted on and extending between end support plates 34 and 35. Front guide bracket 160 has a front guide roll shaft 162 mounted thereon and a central opening 164 that allows viewing of the printed envelope PE as it travels from printer platen 14. Front guide roll shaft 162 has front guide rolls 166 mounted thereon for rotation about an axis spaced from and parallel with the axis of lower transporting roll shaft 109. A spring 168 normally urges front guide rolls 166 into engagement with transporting rolls 116 of lower transporting roll shaft 109 for guiding the printed envelope PE traveling on belts 118 and 119 from printer platen 14. Belts 118 and 119 then drive the printed envelope PE into the nip between the contacting portions, of belts 118 and 119 and belts 122 and 123 adjacent transporting drive shaft 110.

After passing between the contacting portions of belts 118, 119, 122 and 123 extending between transporting drive shaft 110 and transporting roll shaft 111, the printed envelope PE is delivered to printed envelope receiving hopper 50. The stack of printed envelopes PE is supported in a generally horizontal, upwardly sloped position by the combined action of the movable printed receiving hopper vertical rear wall 54 and the transporting rolls 116 of transporting roll shafts 112 and 113. Since each successive printed envelope PE is placed at the side of the stack of printed envelopes PE opposite printed envelope hopper vertical rear wall 54, the stack of printed envelopes PE is automatically collated with the first printed envelope PE adjacent rear wall 54 and the last printed envelope PE adjacent shafts 112 and 113.

In operation, a stack of blank envelopes BE is provided in lower blank envelope feeding hopper 40, the stack of blank envelopes BE being supported in its generally horizontal, downwardly sloped position by envelope extracting mechanism 60 and movable hopper vertical movable rear wall 48. The high friction surfaces 68 of envelope engaging rolls 66 of drive shafts 62 and 63 pick up the last envelope from the stack of blank envelopes BE and drive it upwards. Drive shafts 62 and 63 are driven by envelope extracting motor 70 through envelope extracting belt 72.

As the extracted blank envelope BE moves upwards, its top edge encounters the horizontal feed guide bracket 82, which guides the extracted blank envelope BE toward input path 102 of envelope transporting mechanism 100. The top edge of the blank envelope BE then hits protruding arm 92 of switch 90, which is connected and arranged to disable envelope extracting motor 70. In the event a second blank envelope is extracted before motor 70 is disabled, high friction surfaces 84 on the undersurface 86 of horizontal bracket 82 impede the movement of this second blank envelope and prevent it from being fed to envelope transporting mechanism 100.

A momentary delay of motor 70 allows envelope engaging rolls 66 of drive shaft 62 to drive the first extracted blank envelope BE into the nip formed by transporting rolls 116 of transporting roll shaft 107 and belts 118 and 119 before motor 70 is stopped. The blank envelope BE, traveling on belts 118 and 119, passes roll shaft 108 and moves into the slot between rear guide bracket 140 and rear guide plate 141.

Spring 148 nomrally urges rear guide bracket 140 lightly toward transporting rolls 116 of lower transporting roll shaft 109 to allow the blank envelope BE to position itself between platen pinch rolls 20 and the printer platen 14. Thus positioned, rear guide envelope sensing photocell 152 senses the presence of the blank envelope BE positioned between platen pinch rolls 20 and printer platen 14 and actuates solenoid 150. Solenoid 150 then swings rear guide bracket 140 toward lower transporting roll shaft 109, forcing rear guide rolls 146 into firm nipping engagement with belts 118 and 119 trained around transporting rolls 116 in order to drive the blank envelope compressed therebetween into the nip between platen pinch rolls 20 and printer platen 14.

As the blank envelope BE is advanced by the rotation of printer platen 14, its front edge is sensed by a printing position envelope sensing photocell 154 which is connected and arranged to disable envelope transporting motor 130 in order to stop envelope transporting mechanism 100 for printing of the blank envelope BE by printer 12 in the usual manner. After the completion of the printing of the envelope, envelope transporting motor 130 activates envelope transporting mechanism 100 to deliver the printed envelope PE from printer platen 14 to printed envelope receiving hopper 50.

Front guide rolls 166 of spring-biased front guide bracket 160 cooperate with transporting rolls 116 of lower transporting roll shaft 109 to drive the printed envelope PE compressed therebetween into output path 104.

As the printed envelope PE travels between front guide bracket 160 and front guide plate 161, central opening 164 of bracket 160 allows viewing of the printed envelope PE. Belts 118 and 119 then force the printed envelope PE into the nip formed between belts 118 and 119 and belts 122 and 123 adjacent transporting drive shaft 110.

After passing between the contacting portions of belts 118, 119, 122 and 123 extending between transporting drive shaft 110 and transporting roll shaft 111, the printed envelope PE is delivered to printed envelope receiving hopper 50. The stack of printed envelopes PE is supported in a generally horizontal, upwardly sloped position by the combined action of movable printed envelope receiving hopper vertical rear wall 54 and transporting rolls 116 of transporting roll shafts 112 and 113. Furthermore, since each successive printed envelope PE is placed at the side of the stack of printed envelopes PE opposite the printed envelope hopper vertical rear wall 54, the stack of printed envelopes PE is automatically collated with the first printed envelope PE adjacent rear wall 54 and the last printed envelope PE adjacent shafts 112 and 113.

What is claimed is:

1. An envelope feeder for a printer having a rotatable platen and cooperating printing means, platen drive means, and platen pinch roll means, said feeder comprising a blank envelope feeding hopper for supporting a stack of blank envelopes envelope extracting means for extracting an envelope from said stack of blank envelopes in said blank envelope feeding hopper, said extracting means including envelope engaging means adapted to contact the last envelope on said stack of blank envelopes to extract said last envelope and envelope transporting means for transporting said extracted last blank envelope to said printer platen for printing and thereafter transporting said extracted printed envelope away from said printer platen printing position envelope sensing means for sensing the arrival of an extracted envelope in the proper position for printing, said printing position envelope sensing means being connected and arranged to stop said transporting means for printing of said extracted envelope by said printer, and said transporting means having drive means responsive to completion of said printing to restart said transporting means.

2. An envelope feeder as claimed in claim 1, wherein said envelope engaging means includes a pair of rolls mounted for rotation about axes spaced from one another.

3. An envelope feeder as claimed in claim 2, further comprising envelope feed guide means spaced above the surface of said envelope engaging means for guiding a single envelope from said stack of blank envelopes, said feed guide means comprising extracted envelope sensing means responsive to extraction of said last blank envelope connected and arranged to disable said envelope extracting means to prevent feeding a second envelope to said printer.

4. An envelope feeder as claimed in claim 3, wherein said envelope transporting means includes envelope transporting roll and belt means defining input and output paths and rotating about axes spaced from and parallel to the axis of said envelope engaging roll means, said transporting means including a lower transporting means.

5. An envelope feeder for a printer having a rotatable platen and cooperating printing means, platen drive means, and platen pinch roll means, said feeder comprising a blank envelope feeding hopper for supporting a stack of blank envelopes envelope extracting means for extracting an envelope from said stack of blank envelopes in said blank envelope feeding hopper, said extracting means including envelope engaging means adapted to contact the last envelope on said stack of blank envelopes to extract said last envelope extracted envelope sensing means responsive to extraction of said last blank envelope connected and arranged to disable said envelope extracting means, and envelope transporting means for transporting said extracted last blank envelope to said printer platen for printing and thereafter transporting said extracted printed envelope away from said printer platen printing position envelope sensing means for sensing the presence of an extracted envelope positioned on said printer platen ready for printing, said printing position envelope sensing means being connected and arranged to stop said transporting means for printing of said extracted envelope by said printer, and said transporting means being responsive to completion of said printing to move the printed envelope from said printer platen, further comprising rear envelope guide means for guiding said envelope traveling on said envelope transporting means to the printer platen, said near guide means having rear guide roll means rotatably mounted on said rear guide means for rotation about an axis spaced from and parallel to the axis of said lower transporting means spring means normally urging said rear guide means lightly toward said lower transporting means to allow said envelope to position itself between the platen pinch roll means and the platen of said printer solenoid means for urging the rear guide roll means of said rear guide means into firm nipping engagement with said lower transporting means to force said envelope compressed therebetween into the nip between the platen pinch roll means and the platen, and rear guide envelope sensing means for sensing the presence of said envelope positioned between the platen pinch roll means and the platen, said rear guide envelope sensing means actuating the solenoid means of said rear guide means to drive said envelope around the platen of said printer.

6. An envelope feeder for a printer having a rotatable platen and cooperating printing means, platen drive means, and platen pinch roll means, said feeder comprising a blank envelope feeding hopper having a bottom wall and a movable rear wall for supporting a stack of blank envelopes a printed envelope receiving hopper having a bottom wall for supporting a stack of printing envelopes envelope extracting means for extracting an envelope from said stack of blank envelopes in said blank envelope feeding hopper, said extracting means including envelope engaging roll means rotating about an axis spaced from and parallel to said blank envelope feeding hopper vertical rear wall adapted to contact the last envelope at the bottom side of said stack of blank envelopes opposite said blank envelope feeding hopper vertical rear wall, for supporting said stack of blank envelopes between said envelope engaging roll means and said blank envelope feeding hopper vertical rear wall, and for extracting said last envelope from said stack of blank envelopes extracted envelope sensing means responsive to extraction of said last blank envelope connected and arranged to disable said envelope extracting means envelope transporting means for transporting said extracted last blank envelope along an input path to said printer platen and transporting said extracted printed envelope along an output path from said printer platen to said printed envelope receiving hopper, and printing position envelope sensing means for sensing the presence of said extracted blank envelope positioned on said printer platen ready for printing said printing position envelope sensing means being connected and arranged to disable said transporting means to stop said transporting means for printing of said extracted envelope by said printer, and said transporting means being responsive to completion of said printing to deliver the printed envelope from the printer platen to said envelope receiving hopper.

7. An envelope feeder as claimed in claim 6, further comprising envelope feed guide means spaced above the surface of said envelope engaging roll means for guiding a single envelope from said stack of blank envelopes.

8. An envelope feeder as claimed in claim 6, wherein said envelope transporting means comprises envelope transporting roll and belt means defining said input and output paths and rotating about axes spaced from and parallel to the axis of said envelope engaging roll means, said transporting means including a lower transporting means.

9. An envelope feeder as claimed in claim 8, further comprising front envelope guide means for guiding said printed envelope from the printer platen, said front guide means having front guide roll means rotatably mounted on said front guide means for rotation about an axis spaced from and parallel to the axis of said lower transporting means, said front guide means guiding said printed envelope traveling on said transporting means to said printed envelope receiving hopper.

10. An envelope feeder for a printer having a rotatable platen and cooperating printing means, platen drive means, and platen pinch roll means, said feeder comprising a blank envelope feeding hopper having a bottom wall and a movable rear wall for supporting a stack of blank envelopes a printed envelope receiving hopper having a bottom wall for supporting a stack of printed envelopes envelope extracting means for extracting an envelope from said stack of blank envelopes in said blank envelope feeding hopper, said extracting means including envelope engaging roll means rotating about an axis spaced from and parallel to said blank envelope feeding hopper vertical rear wall adapted to contact the last envelope at the bottom side of said stack of blank envelopes opposite said blank envelope feeding hopper vertical rear wall, for supporting said stack of blank envelopes between said envelope engaging roll means and said blank envelope feeding hopper vertical rear wall, and for extracting said last envelope from said stack of blank envelopes extracted envelope sensing means responsive to extraction of said last blank envelope connected and arranged to disable said envelope extracting means envelope transporting means for transporting said extracted last blank envelope along an input path to said printer platen and transporting said extracted printed envelope along an output path from said printer platen to said printed envelope receiving hopper, and printing position envelope sensing means for sensing the presence of said extracted blank envelope positioned on said printer platen ready for printing said printing position envelope sensing means being connected and arranged to disable said transporting means to stop said transporting means for printing of said extracted envelope by said printer, and said transporting means being responsive to completion of said printing to deliver the printed envelope from the printer platen to said envelope receiving hopper, further comprising rear envelope guide means for guiding said extracted blank envelope traveling on said envelope transporting means to the printer platen, said rear guide means having rear guide roll means rotatably mounted on said rear guide means for rotation about an axis spaced from and parallel to the axis of said lower transporting means spring means normally urging said rear guide means lightly toward said lower transporting means to allow said envelope to position itself between the platen pinch roll means and the platen of said printer solenoid means for urging the rear guide roll means of said front guide means into firm nipping engagement with said lower transporting means to force said envelope compressed therebetween into the nip between the platen pinch roll means and the platen, and rear guide envelope sensing means for sensing the presence of said envelope positioned between the platen pinch roll means and the platen, said rear guide envelope sensing means actuating said solenoid means of said rear guide means to drive said envelope around the platen of said printer, wherein said envelope transporting means comprises envelope transporting roll and belt means defining said input and output paths and rotating about axes spaced from and parallel to the axis of said envelope engaging roll means, said transporting means including a lower transporting means.

11. An envelope feeder for a printer having a rotatable platen and cooperating printing means, platen drive means, and platen pinch roll means, said feeder comprising a supporting frame adapted to be mounted on said printer and extending thereabove a blank envelope feeding hopper having a generally horizontal bottom wall mounted on said frame and a generally vertical movable rear wall for supporting a stack of blank envelopes an upper printed envelope receiving hopper having a generally horizontal bottom wall mounted on said frame and a generally vertical movable rear wall for supporting a stack of printed envelopes envelope extracting means mounted on said frame for extracting an envelope from said stack of blank envelopes in said blank envelope feeding hopper, said extracting means having envelope engaging roll means mounted on said frame for rotation about an axis spaced from and parallel to said blank envelope feeding hopper vertical rear wall and adapted to contact the last envelope of said stack of blank envelopes opposite said blank envelope feeding hopper vertical rear wall, for supporting said stack of blank envelopes between said envelope engaging roll means and said blank envelope feeding hopper vertical rear wall, and for extracting said last envelope from said stack of blank envelopes envelope feed guide means mounted on said frame and spaced above the surface of said envelope engaging roll means for guiding a single envelope from said stack of blank envelopes extracted envelope sensing means mounted on said frame and responsive to extraction of said last blank envelope connected and arranged to disable said envelope extracting means to prevent feeding a second envelope to said printer envelope transporting means mounted on said frame for transporting said extracted last blank envelope from said feed guide means along an input path to said printer platen and transporting said extracted printed envelope along an output path from said printer platen to said printed envelope receiving hopper, said transporting means having envelope transporting roll and belt means defining said paths rotatably mounted on said frame for rotation about axes spaced from and parallel to the axis of said envelope engaging roll means, said transporting means including lower transporting means rear envelope guide means mounted on said frame for guiding said extracted blank envelope traveling on said envelope transporting means to the printer platen, said rear guide means having rear guide roll means rotatably mounted on said rear guide means for rotation about an axis spaced from and parallel to the axis of said lower transporting means spring means normally urging said rear guide means lightly toward said lower transporting means to allow said blank envelope to position itself between the platen pinch roll means and the platen of said printer solenoid means mounted on said frame for urging the rear guide roll means of said rear guide means into firm nipping engagement with said lower transporting means to force said blank envelope compressed therebetween into the nip between the platen pinch roll means and the platen rear guide envelope sensing means mounted on said frame for sensing the presence of said blank envelope positioned between the platen pinch roll means and the platen, said rear guide envelope sensing means actuating the solenoid means of said rear guide means to drive said envelope around the platen of said printer printing position envelope sensing means mounted on said frame for sensing the presence of said extracted blank envelope positioned on said printer platen ready for printing, said printing position envelope sensing means being connected and arranged to stop said transporting means for printing of said extracted envelope by said printer, said transporting means being responsive to completion of said printing to activate said transporting means to deliver the printed envelope from the printer platen to said printed envelope receiving hopper front envelope guide means mounted on said frame for guiding said printed envelope from the printer platen, said front guide means having front guide roll means rotatably mounted on said front guide means for rotation about an axis spaced from and parallel to the axis of said lower transporting means, and said front guide means guiding said printed envelope traveling on said transporting means from the printer platen to said printed envelope receiving hopper.

* * * * *